US005460379A

United States Patent [19]

Cleland

[11] Patent Number: 5,460,379

[45] Date of Patent: Oct. 24, 1995

[54] GOLF PRACTICE PLATFORM WITH CONTROLLABLE TILT

[75] Inventor: Keith Cleland, Costa Mesa, Calif.

[73] Assignee: Sidehill Golf International, Inc., Costa Mesa, Calif.

[21] Appl. No.: 206,153

[22] Filed: Mar. 7, 1994

[51] Int. Cl.[6] ..... A63B 69/36

[52] U.S. Cl. ..... 273/195 B; 273/195 A

[58] Field of Search ..... 273/195 B, 176 H, 273/187 R, 187.1, 195 R, 195 A

[56] References Cited

U.S. PATENT DOCUMENTS 3,522,947 8/1970 Anderson et al. ..... 273/195 B 3,595,581 7/1971 Anderson et al. ..... 273/176 H 3,639,923 2/1972 Stewart ..... 273/195 B X 5,385,251 10/1994 Ashton ..... 273/195 B

*Primary Examiner*—George J. Marlo

*Attorney, Agent, or Firm*—Edgar W. Averill, Jr.

[57] ABSTRACT

A platform assembly for practicing golf which may be tilted from front to back or side to side or a combination thereof. The platform has a base frame which supports an actuating cross having a lower cross member hinged to the base frame and an upper cross member hinged to a tiltable platform. Hydraulic cylinders are affixed to the actuating cross and cause the platform to tilt in a controllable manner.

15 Claims, 8 Drawing Sheets

Fig. 3
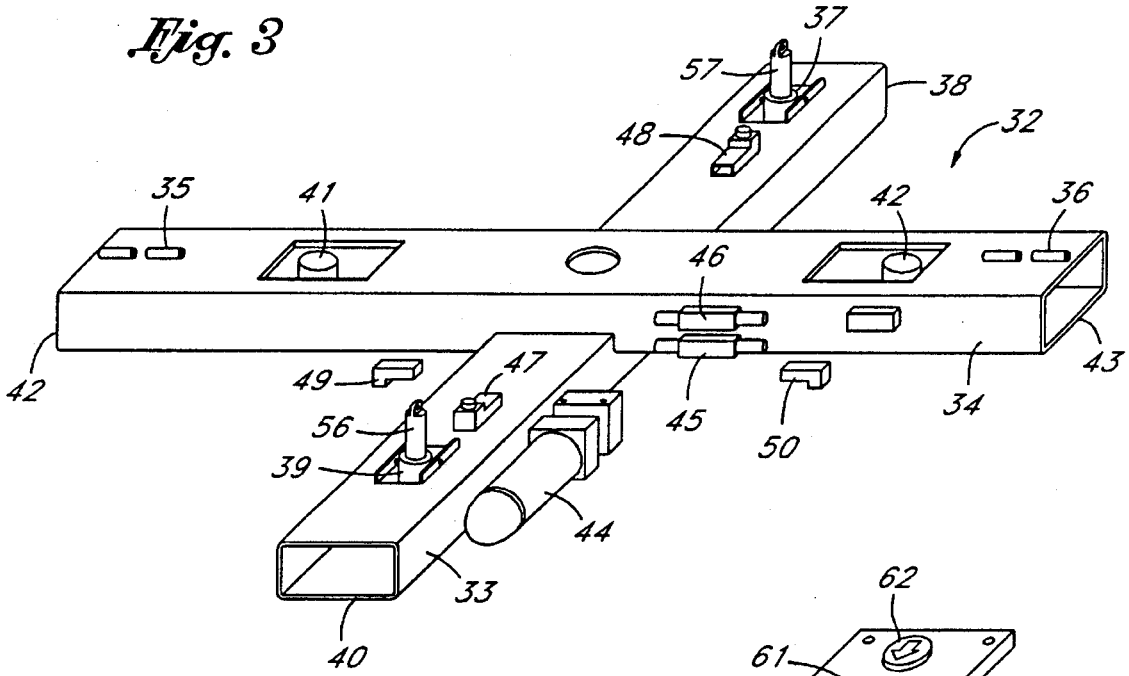
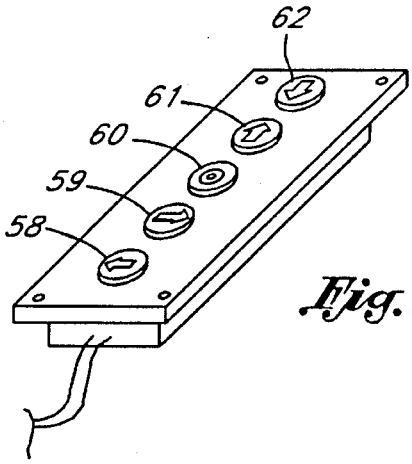
Fig. 4
Fig. 5
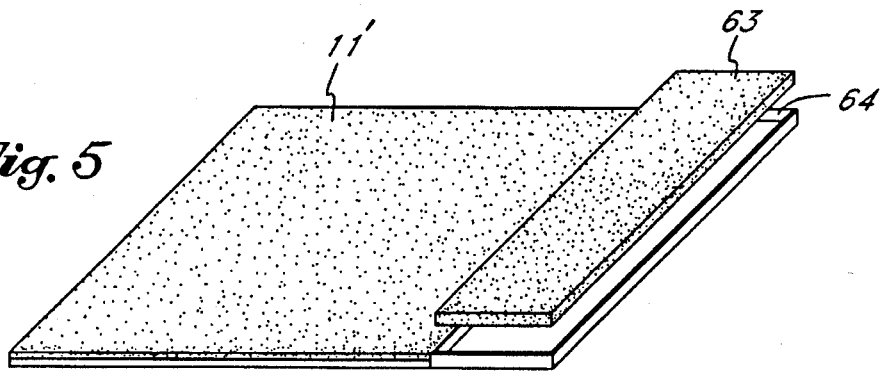

GOLF PRACTICE PLATFORM WITH CONTROLLABLE TILT

BACKGROUND OF THE INVENTION

The field of the invention is golf and the invention relates more particularly to golf practicing platforms of the type which may be tilted.

Most golf driving ranges are built on flat level ground, but in playing the game of golf, the golf ball often lands on a slight slope so that the golfer must hit a sidehill lie, a downhill lie or an uphill lie. Thus, there is a desire for the golfer to practice under such conditions so that when they arise on the golf course he will be more likely to be able to handle it with skill.

Numerous attempts have been made to accomplish this desired end result. One approach is shown in U.S. Pat. No. 2,937,875. In that patent a platform is in the shape of an octagon and has hinges along each of the eight sides. Hinge bars 16 and 17 are placed in one of the eight pairs of hinges and a hydraulic jack which is centrally located in the platform is raised to tilt the platform in one of the eight directions. Because the platform is supported entirely by a pair of hinges coupled by a removable hinge bar it would naturally tend to be somewhat unstable during a golf swing. Furthermore, as soon as a golfer wishes to change the tilt, the platform must be lowered, the hinge pins removed and replaced in a second pair of hinges and the jack once again elevated. The result is a device of limited use.

A device which is automated is shown in U.S. Pat. No. 3,633,918 where a platform may be remotely tilted and has two motive means to control the tilt.

Another controllable platform is shown in U.S. Pat. No. 4,875,684 where a pair of jacks are positioned to move the platform to a desired tilt. Yet another tiltable platform for golf practice is shown in U.S. Pat. No. 5,005,837 where the platform is supported on a pair of rings which permits relative turning which permits the platform to be oriented in any direction.

Lastly, British Patent No. 2,177,010 discloses a platform which is supported by adjustable feet and may be positioned depending on the adjustment of the feet.

The basic problem with all of the above systems is their lack of stability and difficulty of operation. A golf swing involves a substantial shifting in weight and if the platform is not completely stable it does not present a realistic practicing opportunity.

SUMMARY OF THE INVENTION

It is an object of the present invention to provide a tiltable platform assembly for practicing a golf swing from a non-horizontal surface which is free of any noticeable movement during a swing and which has ease of operation and is safe to use.

The present invention is for a platform assembly for practicing golf which platform may be tilted from front to back or side to side or a combination thereof. The platform is supported on a frame and has an actuating cross with a first arm oriented from back to front and a second arm from right to left and the first arm is hingedly affixed to the frame. A tiltable platform is hingedly affixed to the second arm of the actuating cross. Means are provided for tilting the platform with respect to the first arm. Means are also provided for tilting the second arm with respect to the frame. Means for controlling the means for tilting are also provided. Preferably, the means for tilting comprise double action hydraulic cylinder assemblies positioned near the respective ends of the two arms of the actuating cross. Preferably the hydraulic cylinders are all supported by the actuating cross which also supports a hydraulic pump and appropriate valves.

BRIEF DESCRIPTION OF THE DRAWINGS

FIG. 3 is an enlarged perspective view of the actuating cross of FIG. 2*b*.

FIG. 4 is a perspective view of the control panel of the platform assembly of FIG. 1.

FIG. 5 is a perspective view of an alternate embodiment of an upper surface of the platform assembly of FIG. 1.

DESCRIPTION OF THE PREFERRED EMBODIMENTS

Figure 1:
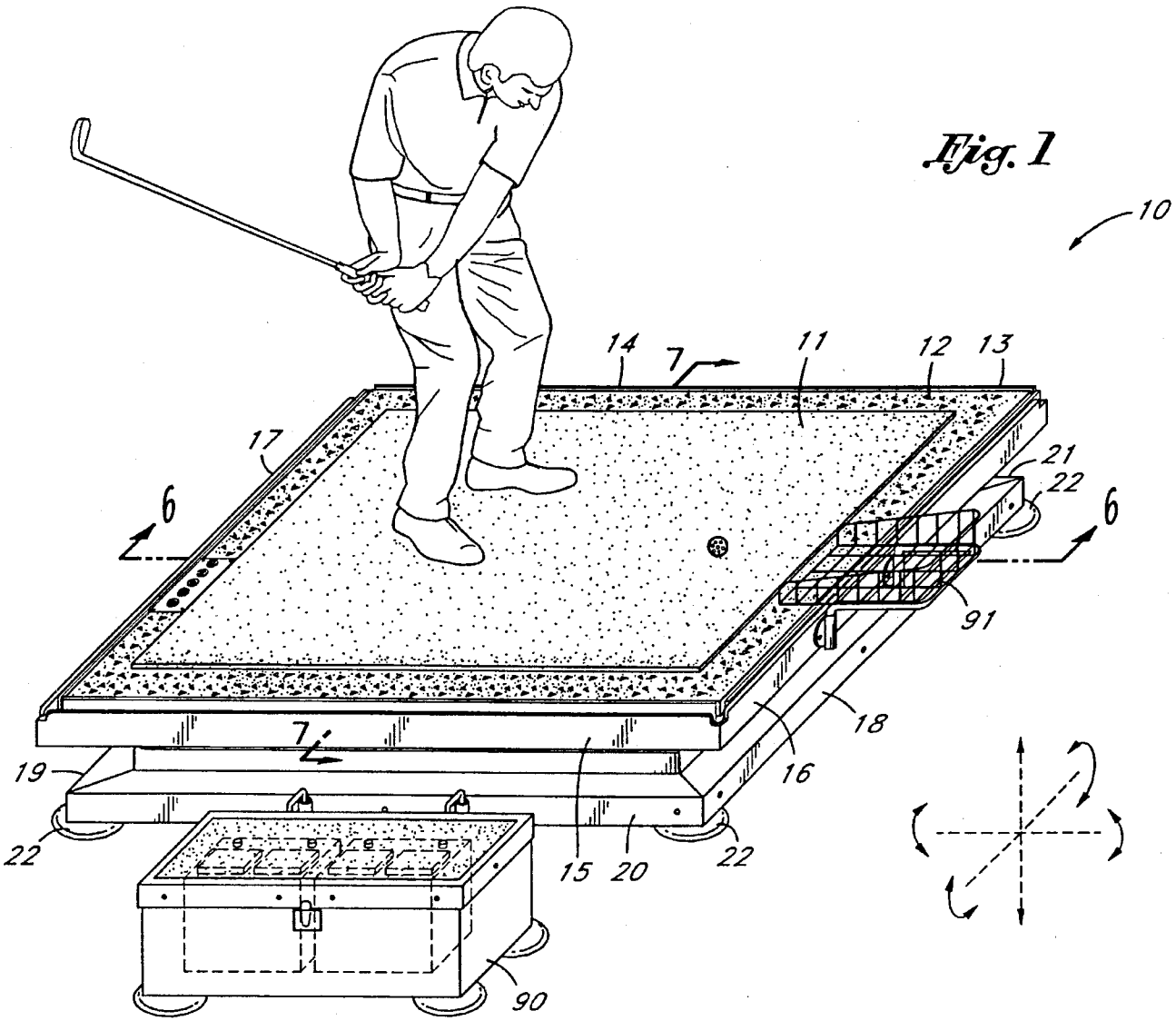
FIG. 1 is a perspective view of the platform assembly for practicing golf of the present invention.

FIG. 1 is a perspective view of the platform assembly of the present invention which is indicated generally by reference character 10. Platform 10 has a practice surface 11 which may be Astro Turf or other desired material. A rubber warning track 12 surrounds practice surface 11 and a peripheral ledge 13 helps prevent a golf ball from rolling off of the surface.

Platform assembly 10 is best described by reference to front, back right and left although it is to be understood that these orientations are merely for facilitating a description of the apparatus which, of course, may be oriented in any direction or may have a circular upper platform and frame.

Platform 10 as depicted in FIG. 1 has a front 14, a back 15, a right side 16 and a left side 17. Platform assembly 10 is shown with a square frame which also has a right side 18, a left side 19, a back 20 and a front 21. Adjustable feet 22 permit the frame to be secured even if the ground is not exactly horizontal.

Figure 2A:
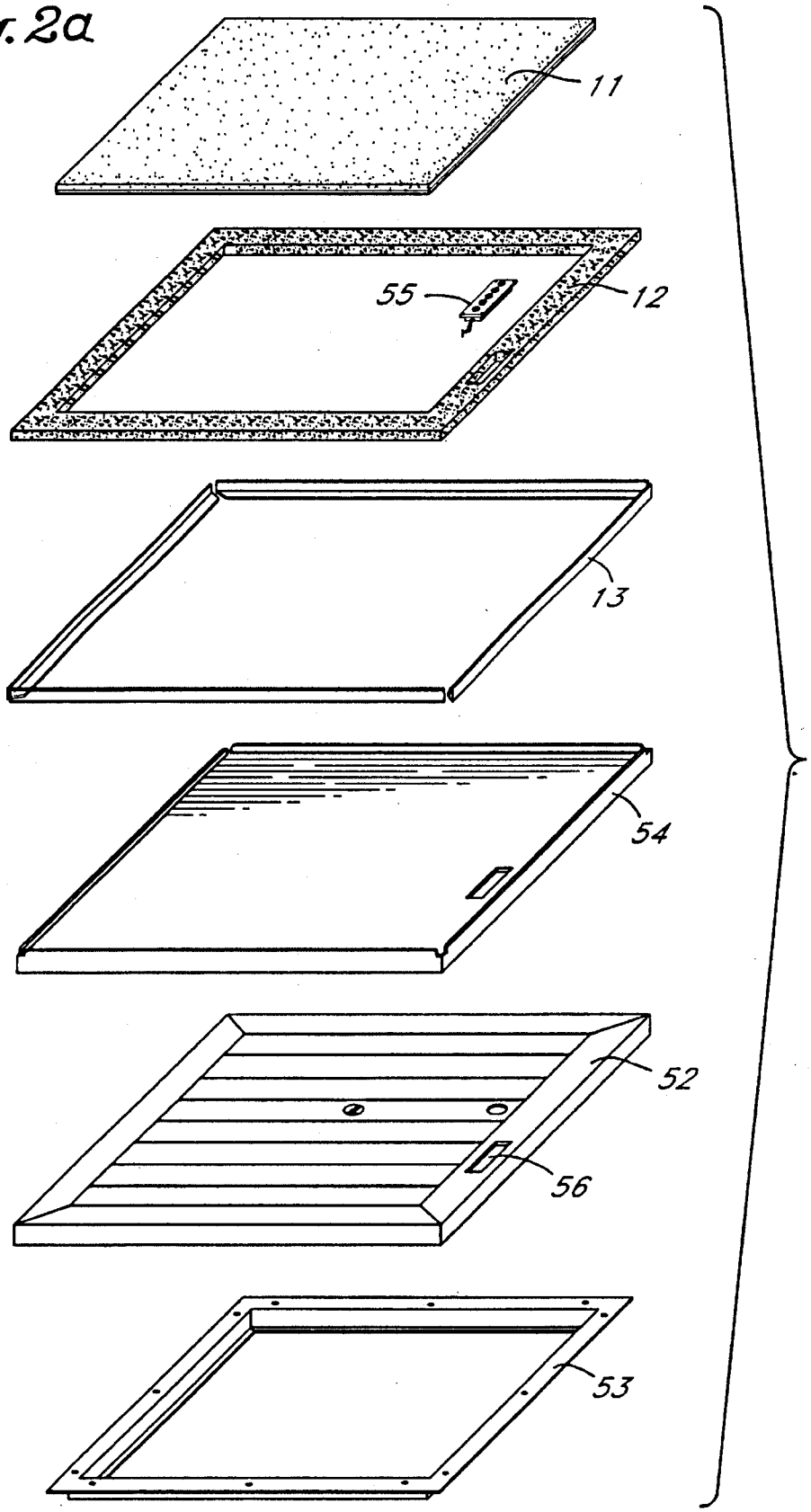
FIG. 2*a* is an exploded perspective view of the upper portion of the platform assembly of FIG. 1.
Figure 2B:
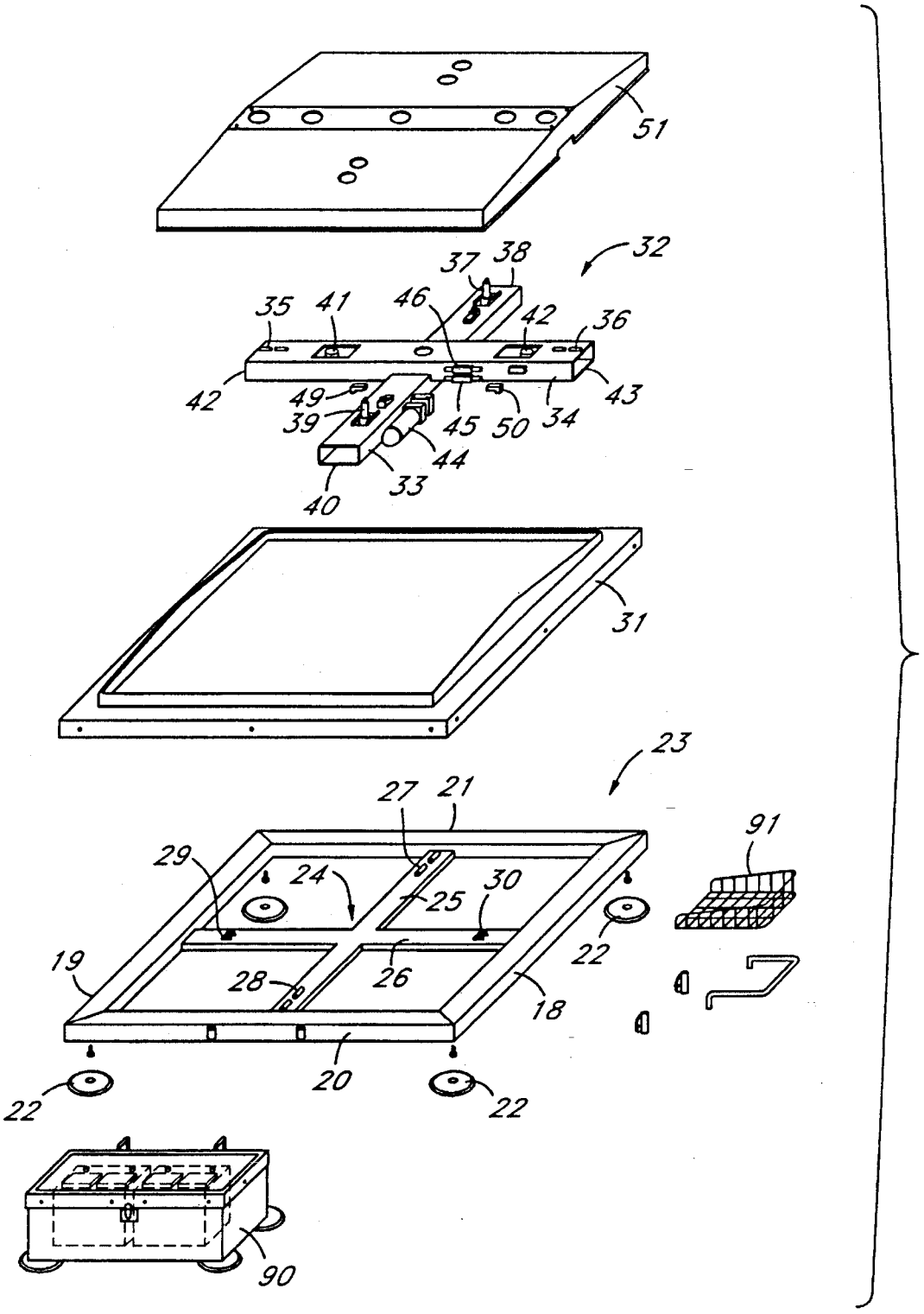
FIG. 2*b* is an exploded perspective view of the bottom portion of the platform assembly of FIG. 1.

The details of construction of platform assembly 10 are shown in exploded perspective view in FIGS. 2*a* and 2*b*. Starting at the bottom in FIG. 2*b*, frame 23 can be seen to have a cross frame 24 with a front to back arm 25 secured between the front and back 21 and 20, respectively, of frame 23. A right to left arm 26 passes between the right side 18 and the left side 19 of frame 23. The lower portion of two hinges 27 and 28 are shown as affixed to front to back arm 25 and hydraulic cylinder rod supports 29 and 30 are affixed near the ends of right to left arm 26.

A plastic shield 31 fits over frame 23. An actuating cross 32 is an important part of the present invention. Actuating cross 32 has a first arm 33 which is hingedly affixed to front to back arm 25. A second arm 34 has hinge portions 35 and 36 which support the platform base as described below. Actuating cross 32 also supports a first hydraulic cylinder 37 near the front end 38 of first arm 33. A hydraulic cylinder assembly 39 is near the back end 40 of first arm 33. A third hydraulic cylinder 41 is held near the left end 42 of second arm 34 and a fourth hydraulic cylinder 42 is held near right end 43 of second arm 34. A hydraulic pump 44 and solenoid controlled valves 45 and 46 are also supported by actuating cross 32. Limit switches 47, 48, 49 and 50 are further held by actuating cross 32. The hinges which hold actuating cross 32 to front to back arm 25 are heavy duty hinges with no play in them so that the actuating cross is very securely affixed to frame 23 in a tiltable manner.

Next, a plastic cover 51 is held over actuating cross 32. The tiltable platform is fabricated from heavy wall steel rectangular tubing members and is hingedly affixed at its bottom surface to hinge portions 35 and 36 on second arm 34. Tiltable platform 52 is covered by a cover 54. A shield 53 having a downwardly extending portion protects the side of the assembly as shown best in FIGS. 6*a*, 6*b*, 7*a* and 7*b*. The peripheral ledge 13 is shown above cover 54 and the rubber track 12 above that. Peripheral ledge 13 is preferably fabricated from a soft, flexible material to help retain a golf ball on the platform. The control panel 55 is held by opening 56 in tiltable platform base 52 and the rubber warning track 12 and practice surface 11 complete the assembly.

Further detail of actuating cross 32 are shown in FIG. 3 where it can be seen that hydraulic cylinder assemblies 37 and 39 have their piston rods 56 and 57 directed upwardly. It can also be seen more clearly that first arm 33 is mounted below second arm 34. This permits the desired amount of tilting which can be at least 10° and as much as 15° (or even more if desired). Similarly, hydraulic cylinders 41 and 42 can be seen to have their piston rods (not shown in FIG. 3) directed downwardly.

The control panel as shown in enlarged perspective view in FIG. 4 where five buttons are shown indicated by reference characters 58, 59, 60, 61 and 62. Each of the buttons causes the platform to tilt in the direction of the arrow shown on the button. These buttons can be operated by the golfer merely pressing the club against the desired switch.

Another feature of the present invention is the ability to change practice surface 11. For instance, a flat 63 of natural grass may be placed in a frame 64 adjacent practice surface 11' for use by professional golfers or others who wish to further practice their game under the most realistic conditions possible.

Figure 6A:
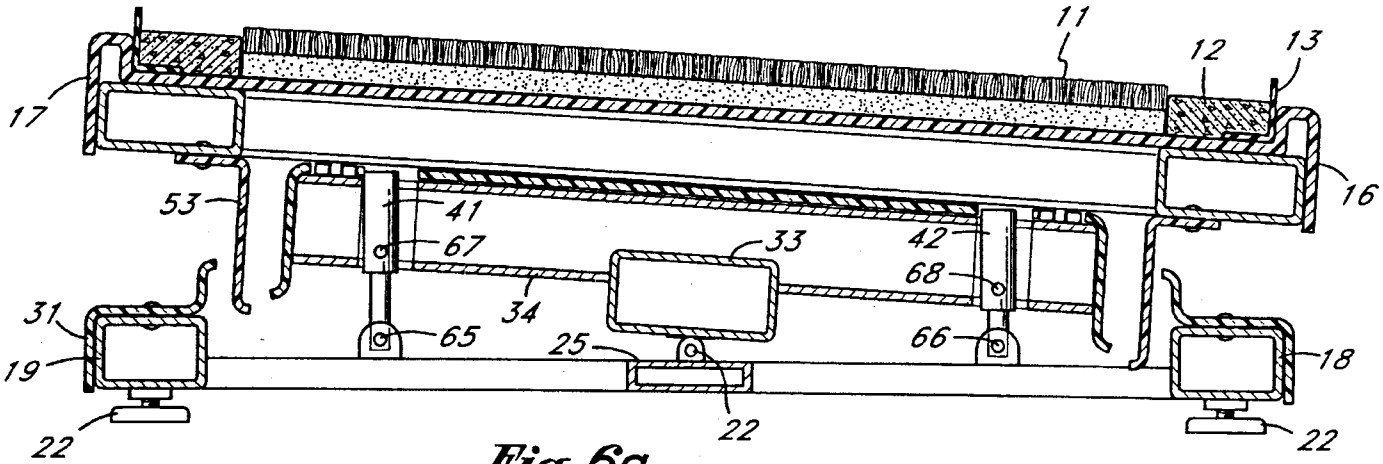
FIG. 6*a* is a cross-sectional view taken along line 6—6 of FIG. 1.
Figure 6B:
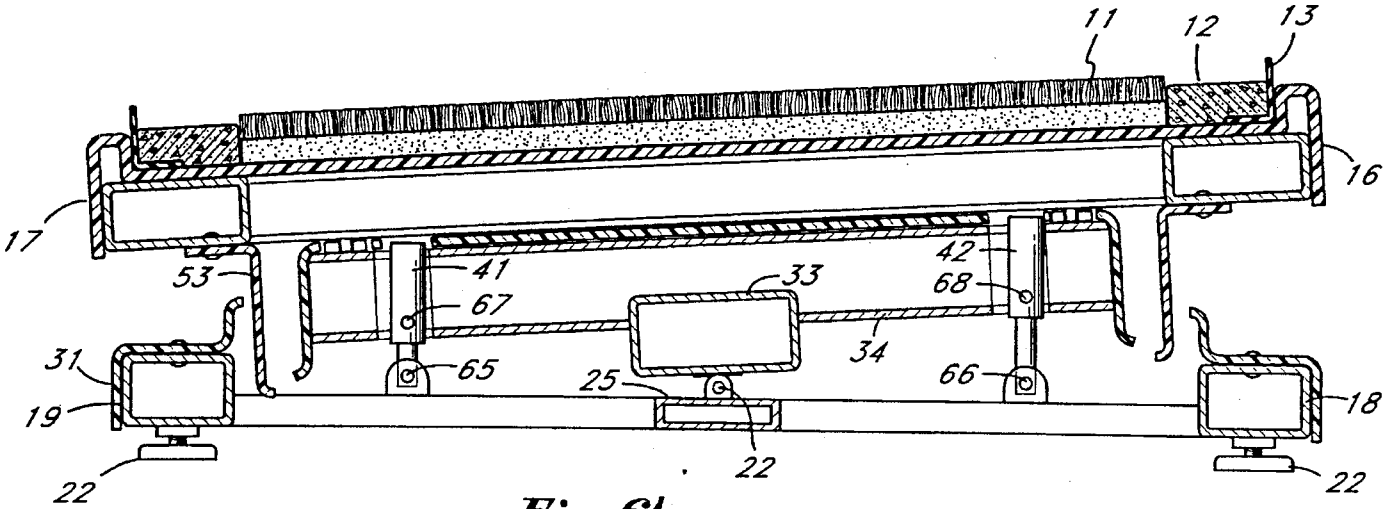
FIG. 6*b* is a cross-sectional view taken along line 6—6 of FIG. 1 with the platform in a different position with respect to FIG. 6*a*.
Figure 7A:
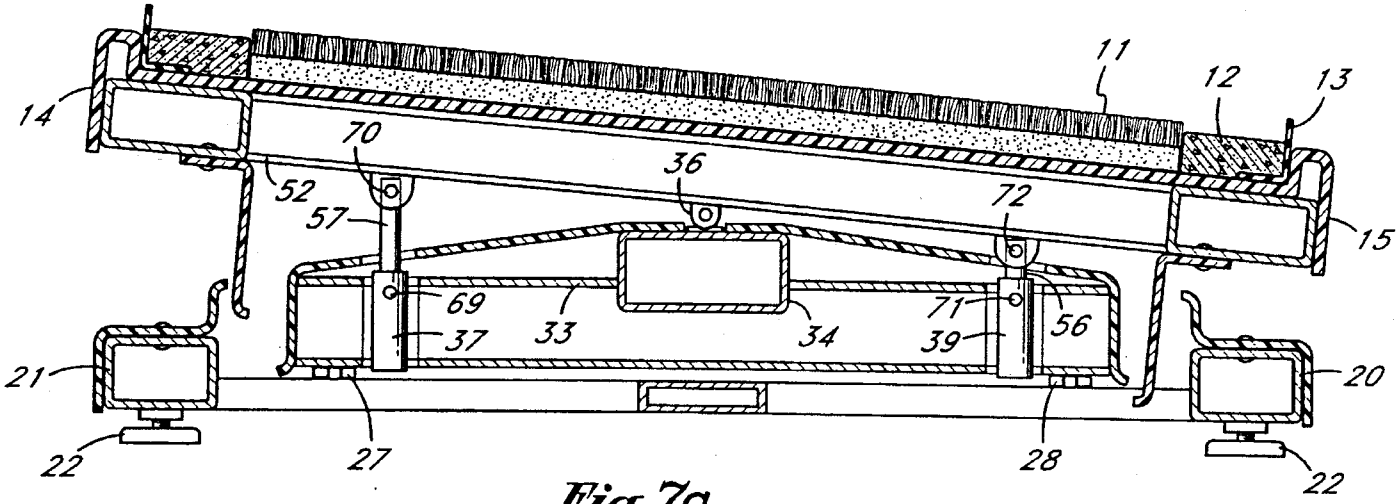
FIG. 7*a* is a cross-sectional view taken along line 7—7 of FIG. 1.
Figure 7B:
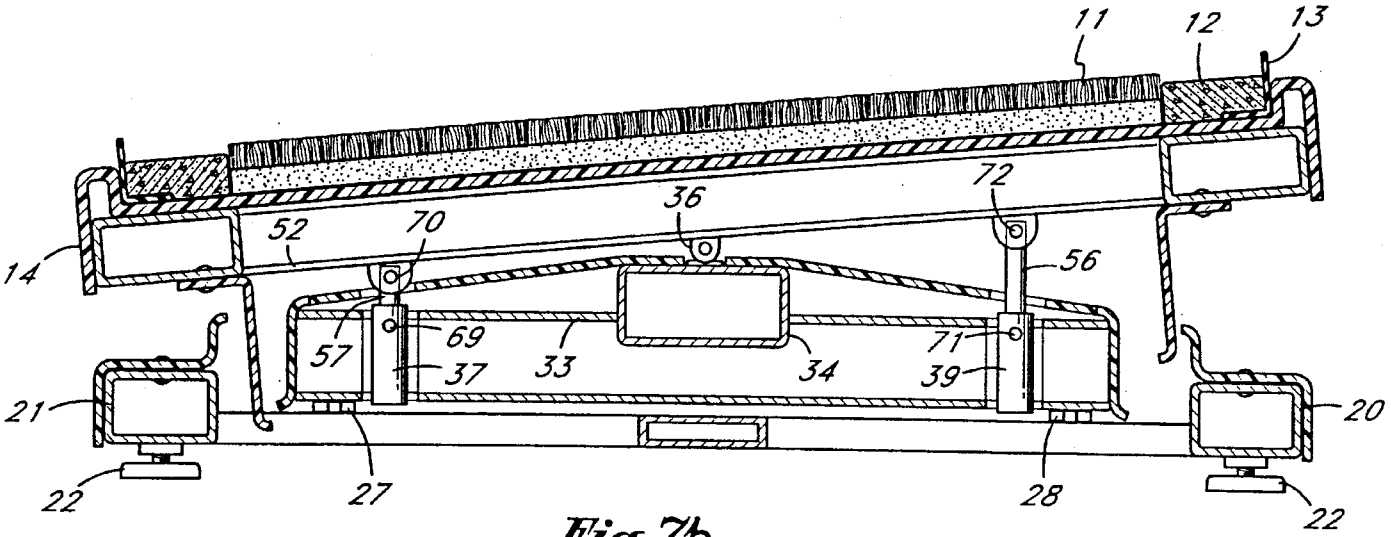
FIG. 7*b* is a cross-sectional view taken along line 7—7 of FIG. 1 showing the platform in a different tilt with respect to FIG. 7*a*.

The tilting action of the platform base 52 is shown most clearly in FIGS. 6 and 7. FIG. 6*a* shows the platform tilted toward the right side and the hinge 27 may be seen on the underside of first arm 33 and as well as on the upper surface of front to back arm 25. It can also be seen in FIG. 6*a* that piston rod 65 of hydraulic assembly 41 is directed downwardly as is piston rod 66 of hydraulic cylinder assembly 42. Hydraulic assembly 41 is pivotly connected to second arm 34 at a point indicated by reference character 67. Similarly, hydraulic cylinder assembly 42 is pivotly connected to second arm 34 at 68. It is also evident in the relationship between shield 31 and shield 53 which helps prevent most objects from entering between the platform and the frame. FIG. 6*b* shows the platform tilted toward the left side. FIGS. 7*a* and 7*b* are taken along line 7—7 of FIG. 1 and show the tilt of the top platform with respect to first arm 33. Hydraulic cylinder assembly 37 is pinned at 69 to first arm 33 and piston rod 57 is pivotly connected at 70 to tiltable platform base 52. Similarly, hydraulic cylinder assembly 39 is pivoted at 71 to first arm 33 and at 72 to the undersurface of tiltable base 52. The remainder of hinge 36 is welded or otherwise securely affixed to the underside of tiltable platform base 52. The platform is tilted toward the back in FIG. 7*a* and toward the front in FIG. 7*b*. It can be understood that the platform can also be tilted toward the right or left side at the same time since hinges 27 and 28 and the appropriate hydraulic cylinder assemblies on second arm 34 can also be tilted independently of the tilt about hinge 36.

Figure 8:
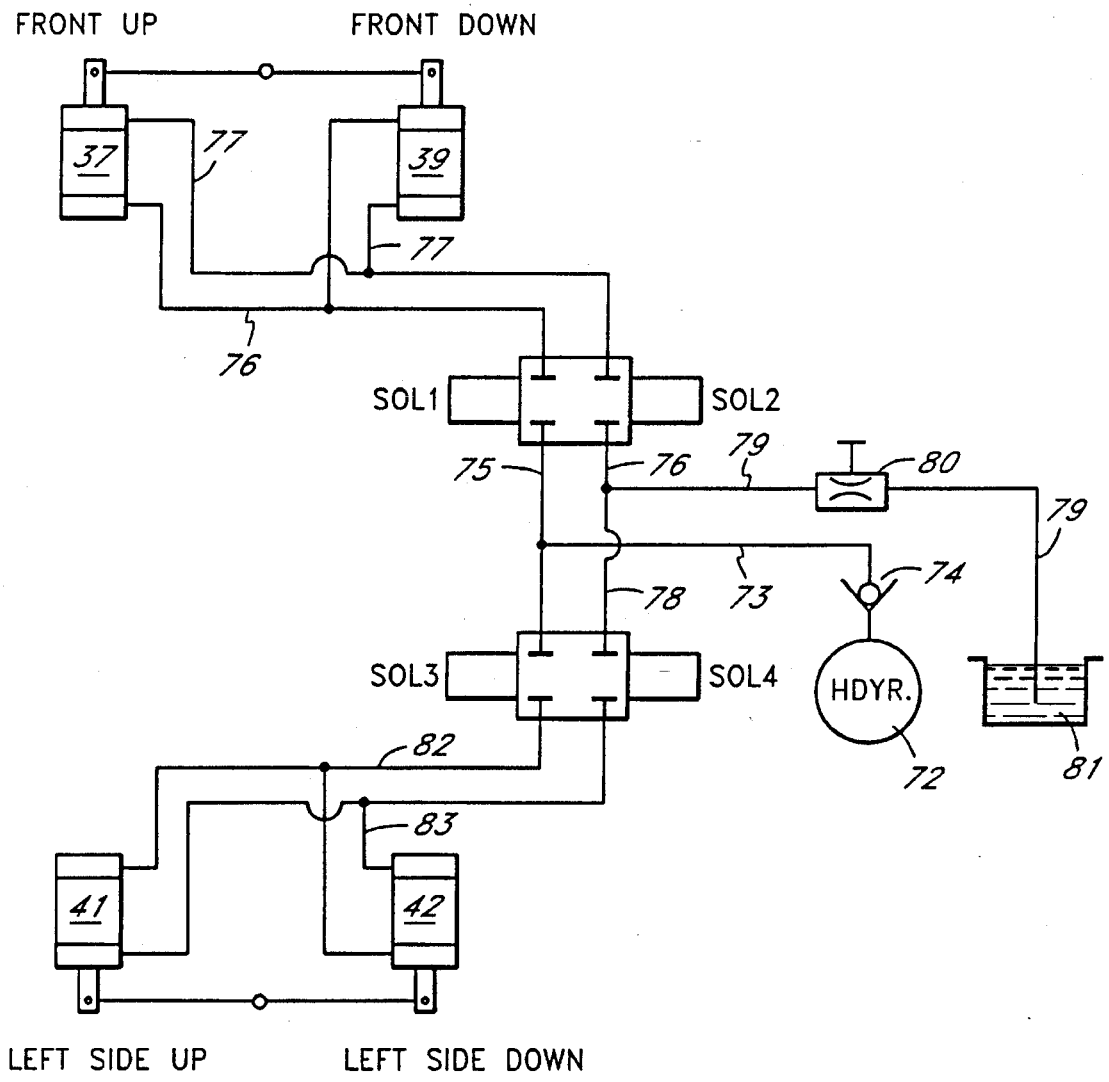
FIG. 8 is a schematic view of the hydraulic assembly of the platform assembly of FIG. 1.
Figure 10:
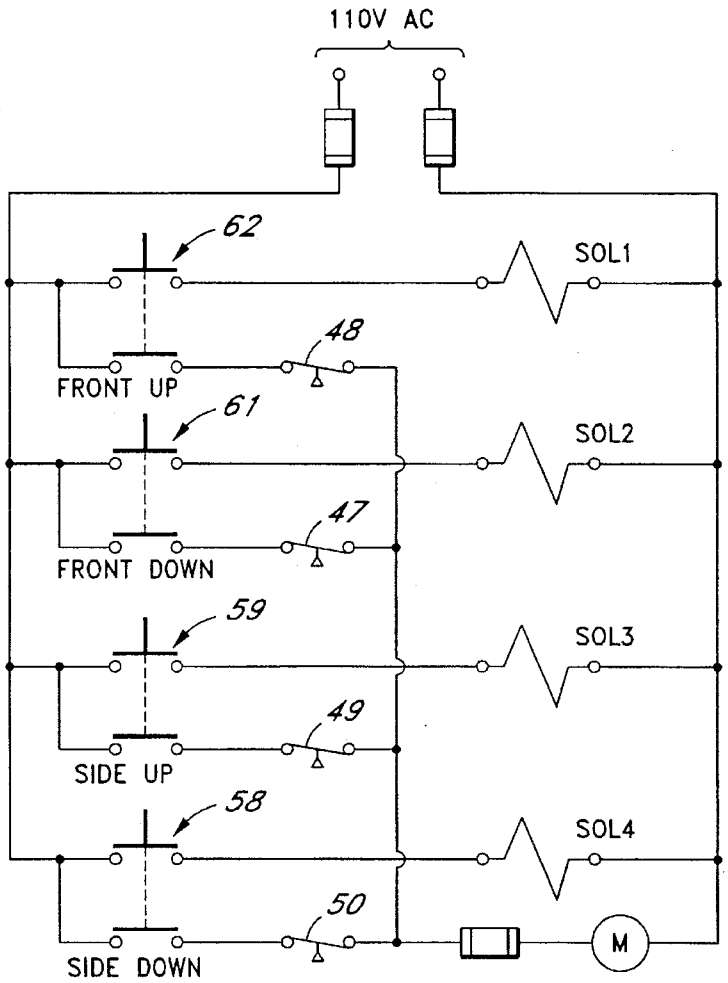
FIG. 10 is an electrical schematic of the platform assembly of FIG. 1 when operated by 110 volt alternative current.

The hydraulic fluid flow path is shown in FIG. 8 where a hydraulic pump 72 pumps the fluid through line 73 and a check valve 74 prevents the hydraulic fluid from passing inwardly into pump 72. Hydraulic fluid under pressure enters line 75 and when solenoid 1 moves in a first direction, hydraulic fluid under pressure enters line 76 causing hydraulic cylinder assembly 37 to extend while at the same time hydraulic fluid passes into the top of hydraulic cylinder 39 causing it to move down. Fluid then exits cylinders 37 and 38 and passes outwardly through line 77 through solenoid 2 through lines 78 and 79 through flow rate controller 80 and into hydraulic fluid reservoir 81. Conversely, when solenoid 2 is energized, fluid under pressure passes from line 75 into line 77 and returns through line 76 causing the pistons in cylinders 37 and 39 to move in the reverse direction. Similarly, when solenoid 3 is energized, hydraulic fluid under pressure passes through lines 75 into 82 causing hydraulic cylinder assembly 41 to extend urging the left side up and hydraulic cylinder assembly 42 to contract allowing fluid to pass through line 83 through solenoid 4 through and into line 78 and from thence to the hydraulic reservoir. Of course, when solenoid 4 is energized, the cylinder assemblies move in the reverse direction.

Figure 9:
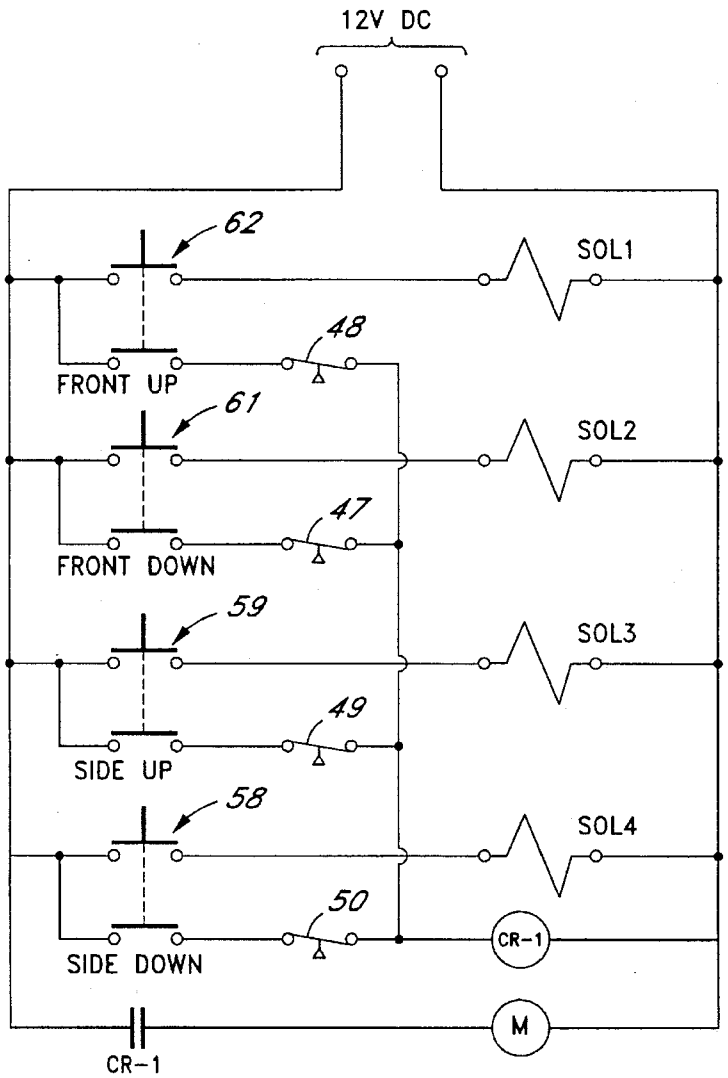
FIG. 9 is an electrical schematic of a battery operated platform assembly of FIG. 1.

The electrical circuit diagram for a battery operated system is shown in FIG. 9 where the limit switch buttons 58, 59, 61 and 62 are shown. The pushing down of push button 62 energizes solonoid 1 and also energizes the motor. If the limit switch 48 is open then the motor cannot be energized preventing damage to the apparatus. The remaining buttons work in the same manner and the AC circuit operates in an analogous manner.

While the device of the present invention has been shown with hydraulic cylinder assemblies and this is the preferred version that could, of course, operate with other motive means, such as interconnected worm drive assemblies. The hydraulic fluid system, however, is advantageous since there is essentially no play in the double actuated hydraulic cylinders. Note that it is preferred that each hydraulic piston have fluid on both sides so that no vacuum can form permitting movement.

While the platform is shown as rectangular it can, of course, be circular, octangular or any other shape depending upon the aesthetics. The device is relatively low to the ground and the battery container 90 of FIG. 1 can serve as a handy step. A basket for containing golf balls is also shown in FIG. 1 and indicated by reference character 91.

The result is a platform which is very stable in use and yet which is easily controlled by the user or independently by a teaching professional. The construction is such that it should be capable of extended use without service and further be capable of withstanding the elements.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A platform assembly for practicing golf, which assembly includes a tiltable platform having a front, a back, a right side and a left side and which may be tilted from front to back or side to side or a combination thereof and provides a sturdy surface for practicing a golf swing, said platform assembly comprising:

a base frame supported by the ground, said base frame having a front, a back, a right side and a left side;

an actuating cross member having a first arm with a front end and a back end oriented front to back with respect to the platform frame and a second arm having a right end and a left end affixed to the first arm and oriented right to left with respect to the tiltable platform and the first arm being hingedly affixed to said base frame and said first and second arms intersecting at a cross center;

said tiltable platform being hingedly affixed to the second arm;

means for tilting the tiltable platform with respect to the first arm;

means for tilting the second arm with respect to the base frame; and means for controlling the means for tilting to position the tiltable platform in a desired orientation.

2. The platform assembly of claim 1 wherein said means for tilting the platform with respect to first arm comprises:

a first and a second hydraulic cylinder assembly each having a cylinder, a piston and a piston rod and said first and second hydraulic cylinder assemblies being affixed away from the cross center toward the front and back ends respectively of the first arm and being connected between the first arm and the tiltable platform; and said means for tilting the second arm with respect to the base frame comprises;

a third and a fourth hydraulic cylinder assembly each having a cylinder, a piston and a piston rod and said second and third hydraulic cylinder assemblies being affixed away from the cross toward the right and left ends of the second arm and being connected between the second arm and the base frame.

3. The platform assembly of claim 2 wherein the actuating cross member is fabricated from rectangular tubing and support the first, second, third and fourth hydraulic cylinders.

4. The platform assembly of claim 3 wherein the actuating cross member also supports a hydraulic pump, valves and a hydraulic fluid reservoir.

5. The platform assembly of claim 1 wherein the first arm is lower than the second arm.

6. The platform assembly of claim 5 wherein the base frame of said tiltable platform assembly has a square outer portion with a front, a back, a right side and a left side and a cross shaped frame member having a front to back arm bisecting the front and back of the square outer portion and a right to left arm bisecting the right and left sides of the square outer portion and the first arm is hingedly affixed to the front to back arm of said cross shaped frame member.

7. The platform assembly of claim 6 wherein said tiltable platform has a downwardly depending safety skirt inwardly positioned with respect to the square outer portion of the base frame.

8. A tiltable platform assembly for practicing a golf swing from a non-horizontal surface, said assembly comprising:

a square frame having front, back, right and left sides supported on a generally horizontal stable surface;

a cross frame affixed to said square frame, said cross frame having a front to back arm affixed midway along the front and back sides of the square frame and also having a right to left arm affixed midway along the right and left sides of the square frame;

an actuating cross having a lower arm hingedly connected to said front to back arm of said cross frame at a point near the right and left sides of the square frame, said actuating cross also having an upper arm affixed at a right angle to said lower arm and extending outwardly from the lower arm in both a right and a left direction;

a tiltable platform hingedly affixed to the upper arm of said actuating cross; and actuating means for controllably tilting said upper arm of said actuating cross about the hinged connection between the cross frame and the lower arm of the actuating cross and for controllably tilting the tiltable platform about the hinged connection between the upper arm of the actuating cross.

9. The tiltable platform assembly of claim 8 wherein a first pair of hydraulic cylinder assemblies is mounted between the lower arm of the actuating cross and the tiltable platform and a second pair of hydraulic cylinder assemblies is mounted between the upper arm of the actuating cross and the cross frame.

10. The tiltable platform assembly of claim 9 wherein the hydraulic cylinder assemblies each have a hydraulic cylinder, a piston and a piston rod and the hydraulic cylinders are all affixed to the actuating cross.

11. The tiltable platform assembly of claim 10 wherein a hydraulic pump and hydraulic valve is also held by said actuating cross.

12. The tiltable platform assembly of claim 11 wherein all of said hydraulic cylinders are double acting hydraulic cylinders.

13. The tiltable platform assembly of claim 8 wherein said tiltable platform has a downwardly depending skirt along an outer edge thereof, said skirt having an upper edge affixed to the tiltable platform and a lower edge affixed to the tiltable platform and a lower edge positioned inwardly and adjacent the square frame.

14. The tiltable platform assembly of claim 13 further including a short upwardly depending flange affixed to the square frame and outwardly with respect to the downwardly depending skirt.

15. The tiltable platform assembly of claim 8 wherein the actuating means further includes a control panel and said control panel is mounted in said tiltable platform and does not extend above said tiltable platform.

* * * * *